US006625741B1

(12) United States Patent
Post et al.

(10) Patent No.: US 6,625,741 B1
(45) Date of Patent: Sep. 23, 2003

(54) ARRANGEMENT FOR A SECURITY MODULE

(75) Inventors: Peter Post, Berlin (DE); Dirk Rosenau, Berlin (DE); Torsten Schlaaff, Zepernick (DE)

(73) Assignee: Francotyp-Postalia AG & Co. KG, Birkenwerder (DE)

( * ) Notice: Subject to any disclaimer, the term of this patent is extended or adjusted under 35 U.S.C. 154(b) by 0 days.

(21) Appl. No.: 09/522,621

(22) Filed: Mar. 10, 2000

(30) Foreign Application Priority Data

Mar. 12, 1999 (DE) ..... 199 12 780

(51) Int. Cl.[7] ..... G06F 1/30

(52) U.S. Cl. ..... 713/340; 340/693.2; 365/228; 365/229

(58) Field of Search ..... 713/300; 320/120, 320/121, 122; 429/97

(56) References Cited

U.S. PATENT DOCUMENTS

| | | | | |
|---|---|---|---|---|
| 4,575,621 A | | 3/1986 | Dreifus | |
| 4,746,234 A | | 5/1988 | Harry | |
| 4,805,136 A | * | 2/1989 | Morino et al. | 708/130 |
| 4,823,323 A | | 4/1989 | Higuchi | |
| 4,903,232 A | * | 2/1990 | O'Connell et al. | 358/1.1 |
| 5,039,580 A | * | 8/1991 | Mori et al. | 429/97 |
| 5,097,253 A | | 3/1992 | Eschbach et al. | |
| 5,229,641 A | | 7/1993 | Katayama | |
| 5,353,350 A | | 10/1994 | Unsworth et al. | |
| 5,490,077 A | | 2/1996 | Freytag | |
| 5,515,540 A | | 5/1996 | Grider et al. | |
| 5,606,508 A | | 2/1997 | Thiel | |
| 5,671,146 A | | 9/1997 | Windel et al. | |
| 5,680,463 A | | 10/1997 | Windel et al. | |
| 5,712,916 A | | 1/1998 | Windel et al. | |
| 5,734,723 A | | 3/1998 | Windel et al. | |
| 5,969,504 A | * | 10/1999 | Cutchis | 320/121 |
| 6,088,762 A | * | 7/2000 | Creta | 711/106 |

FOREIGN PATENT DOCUMENTS

| | | |
|---|---|---|
| DE | PS 43 33 156 | 8/1995 |
| DE | PS 196 05 015 | 3/1997 |
| EP | 0 789 333 | 1/1997 |
| EP | 0 417 447 | 10/1997 |
| GB | 2 303 173 | 2/1997 |
| WO | WO 98/20461 | 5/1998 |

OTHER PUBLICATIONS

Christensen et al, "TI–81 Guidebook." 1992, B–2.*

* cited by examiner

*Primary Examiner*—Thomas Lee
*Assistant Examiner*—Mark Connolly
(74) *Attorney, Agent, or Firm*—Schiff Hardin & Waite

(57) ABSTRACT

In an arrangement for a security module that is plugged via an interface onto a base plate of a postal device, particularly a postage meter machine, the battery is replaceably arranged on the security module, and the voltage monitoring unit includes a circuit for a resettable self-holding, the self-holding being triggered when the battery voltage drops below a predetermined threshold. The status can be interrogated by a processor. The resetting of the self-holding can only be triggered when the battery voltage has risen above the predetermined threshold.

7 Claims, 5 Drawing Sheets

ARRANGEMENT FOR A SECURITY MODULE

BACKGROUND OF THE INVENTION

1. Field of the Invention

The present invention is directed to an arrangement for a security module of the type containing at least one functional unit, such as a processor, which is normally supplied with a system voltage and which has a battery back-up. Such a postal security module is particularly suitable for use in a postage meter machine or mail-processing machine or computer with mail-processing capability.

2. Description of the Prior Art

Modern postage meter machines, such as the thermal transfer postage meter machine disclosed in U.S. Pat. No. 4,746,234, utilize a fully electronic, digital printer. It is thus fundamentally possible to print arbitrary texts and special characters in the franking imprint printing field and an advertising slogan that is arbitrary or allocated to a cost center. For example, the postage meter machine T1000 of the Francotyp-Postalia AG & Co. has a microprocessor that is surrounded by a secured housing that has an opening for the delivery of a letter. When a letter is supplied, a mechanical letter sensor (microswitch) communicates a print request signal to the microprocessor. The franking imprint contains previously entered and stored, postal information for conveying the letter. The control unit of the postage meter machine undertakes an accounting controlled by software, exercises a monitoring function, possibly with respect to the conditions for a data updating, and controls the reloading of a postage credit.

U.S. Pat. No. 5,606,508 (corresponding to German OS 42 13 278) and U.S. Pat. No. 5,490,077 disclose a data input, such as with chip cards, for the aforementioned thermal transfer postage meter machine. One of the chip cards loads new data into the postage meter machine, and a set of further chip cards allows a setting of correspondingly stored data to be undertaken by plugging in a chip card. The data loading and the setting of the postage meter machine can thus ensue more comfortably and faster than by keyboard input. A postage meter machine for franking postal matter is equipped with a printer for printing the postage value stamp on the postal matter, with a controller for controlling the printing and the peripheral components of the postage meter machine, with a debiting unit for debiting postal fees, with at least one non-volatile memory for storing postage fee data, with at least one non-volatile memory for storing security-relevant data and with a calendar/clock. The non-volatile memory of the security-relevant data and/or the calendar/clock is usually supplied by a battery. In known postage meter machines, security-relevant data (cryptographic keys and the like) are secured in non-volatile memories. These memories are EEPROM, FRAM or battery-protected SRAM. Known postage meter machines also often have an internal real time clock RTC that is supplied by a battery. For example, potted modules are known that contain integrated circuits and a lithium battery. After the expiration of the service life of the battery, these modules must be replaced as a whole and disposed of. For economical and ecological reasons, it is more beneficial If only the battery needs to be replaced. To that end, however, the security housing must be opened and subsequently re-closed and sealed since security against attempted fraud is based essentially on the secured housing that surrounds the entire machine.

In European Application 660 269 (U.S. Pat. No. 5,671,146), disclose a suitable method for improving the security of postage meter machines wherein a distinction is made between authorized and unauthorized opening of the security housing.

Repair of a postage meter machine is possible only with difficulty on site where the access to the components is rendered more difficult or limited. Given larger mail-processing machines or devices known as PC frankers, the protected housing in the future will be reduced only to the postal security module. This can improve accessibility to the other components. It would be extremely desirable for economic replacement of the battery for this to be replaced in a relatively simple way. The battery, however, would then be located outside the security area of the postage meter machine. When the battery posts are made accessible from the outside, however, a possible tamperer is able to manipulate the battery voltage. Known battery-supply SRAMs and RTCs have different demands with respect to their required operating voltage. The necessary voltage for holding data of SRAMs is below the required voltage for the operation of RTCs. This means that a reduction of the voltage below a specific limit value leads to an undesired behavior of the component: the RTC stands still and the time of day—stored in SRAM cells—and the memory contents of the SRAM are preserved. At least one of the security measures, for example long time watchdogs, would then be ineffective at the side of the postage meter machine. For a long time watchdog, the remote data center prescribes a time credit or a time duration, particularly a plurality of days or a specific day, by which the franking device should report via a communication connection. After the time credit is exhausted or after the term expires, franking is prevented. European Application 660 270 (U.S. Pat. No. 5,680,463) disclose a method for determining the presumed time duration up to the next credit reloading, and a data center considers any postage meter machine suspicious that does not report in time. Suspicious postage meter machines are reported to the postal authority, which monitors the mail stream of letters franked by suspicious postage meter machines. An expiration of the time credit or of the deadline is also already determined by the franking device and the user is requested to implement the overdue communication.

Security modules are already known from electronic data processing systems. For protection against break-in into an electronic system, European Patent 417 447 discloses a barrier that contains a power supply and a signal acquisition circuit as well as shielding in the housing. The shielding is composed of an encapsulation and electrical lines to which the power supply and signal acquisition circuits are connected. The latter reacts to a modification of the line resistance of the lines. Moreover, the security module contains an internal battery, a voltage switch-over from system voltage to battery voltage and further functional units (such as power gate, short-circuit transistor, memories and sensors). The power gate reacts when the voltage falls below a specific limit. When the line resistance, the temperature or the emission are modified, the logic reacts. The output of the short-circuit transistor is switched to a low logic level with the power gate or with the logic, resulting in a cryptographic key stored in the memory being erased. However, the service life of the non-replaceable battery, and thus of the security module, is too short for use in franking devices or mail-processing machines.

For example, JetMail®, which is commercially available from Francotyp-Postalia AG & Co. is a larger mail-processing machine. Here, a franking imprint is produced with a stationarily arranged ink jet print head with a non-horizontal, approximately vertical, letter transport. A suitable embodiment for a printer device is disclosed in German PS 196 05 015. The mail-processing machine has a meter and a base. If the meter is to be equipped with a housing which allows components to be more easily accessible, then it must be protected against attempted fraud by a postal security module that implements at least the accounting of the postage fees. In order to preclude influence on the program run, European Application 789 333 discloses equipping a security module with an application circuit (ASIC) that contains a hardware accounting unit. The application circuit (ASIC) also controls the print data transmission to the print head.

This approach would not be required if unique imprints were produced for each piece of mail. A method and arrangement for fast generation of a security imprint is disclosed, for example, by U.S. Pat. Nos. 5,680,463, 5,712,916 and 5,734,723. A specific security marking is thereby electronically generated and embedded into the print format.

Further measures for protecting a security module against tampering with the data stored therein are disclosed in German applications 198 16 572.2 and 198 16 571.4. The power consumption increases due to the use of a number of sensors, and a security module not constantly supplied by a system voltage then draws the current required for the sensors from its internal battery, which likewise prematurely drains the battery. The capacity of the battery and the power consumption thus limit the service life of a security module. If, however, the battery terminal posts were to be made accessible from the outside in order to increase the service life of the battery, this would afford the possibility of tampering with the security of the postal data by a defrauder.

Such a security module, not being supplied by a system voltage, could then be manipulated via the externally accessible battery contacts, by causing the voltage to be reduced below the limit voltage specified for the processor. When the processor is equipped with an internal clock RAM (RTC), the clock initially stands still. Given increase of the voltage, the internal clock (RTC) would again resume. Given application of a pulse voltage with pulse width modulation, it must be assured that the battery voltage cannot drop below the specified limit which is the minimum necessary to preserve (avoid erasure of) the memory contents. Given a voltage reduction proceeding below the limit, this condition must be documentably maintained until another, admissible condition is valid. A prognosis of the potential for tampering or of the source of tampering is fundamentally required in order to achieve the desired security level with suitable measures that are appropriate in terms of the outlay. The maxim "as much as necessary, as little as possible", is applicable. The possibility of manipulation must be at least limited with a suitable circuit.

SUMMARY OF THE INVENTION

An object of the present invention is to provide a franking device which assures security against unauthorized manipulation of a security module with a battery that is replaceable.

This object is inventively achieved in a postal device, particularly a postage meter machine, equipped with a pluggable security module that is connected to the system bus of the meter, or to some other suitable control means. With a plug-in security module, which is supplied by a system voltage during service, the battery of the security module can be replaced by a service technician. The security module is potted with a hard compound. The battery, however, is arranged outside the casting compound for replacing the battery or for disposal thereof.

Inventively, the security module has a voltage monitoring unit with resettable self-holding that can be interrogated and reset by the processor. The monitoring of the voltage of a battery that is required for the battery-supported RAM memories and for functioning of an internal clock has the objective of triggering actions given downward transgression of a specific voltage level, these actions leading to the erasing of security-relevant data and of the current time of day. The self-holding allows the condition of the downward transgression of the voltage to be conserved until a dependable documentation is possible. The latter occurs only subsequently when the module is again supplied with the system voltage. An inspector or some other authorized person implementing suitable inputs at the keyboard of the franking device can restore the original condition.

The advantages, in addition to lengthening the service life of the security module due to the possibility of replacing the battery, include a low power consumption of the circuit despite a fast reaction to voltage changes and prevention of a formation of an average value given a manipulation with square-wave pulses at the battery terminals.

DESCRIPTION OF THE PREFERRED EMBODIMENTS

Figure 1:
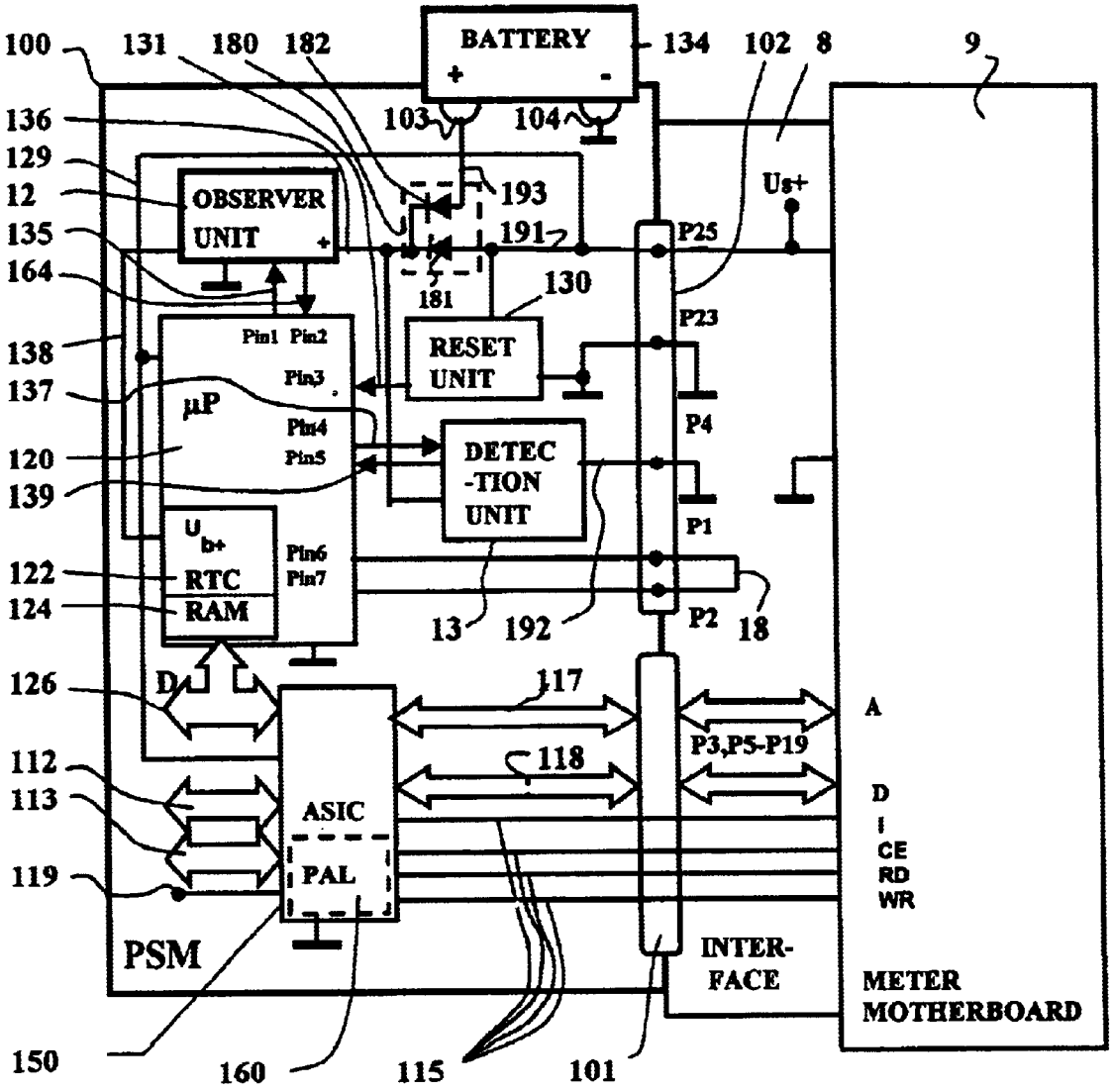
FIG. 1 is a block circuit diagram and interface of the inventive security module.

FIG. 1 shows a block diagram of the security module 100 with the contact groups 101, 102 for connection to an interface 8 as well as to the battery contact posts 103 and 104 of a battery interface for a battery 134. Although the security module 100 is potted with a hard casting compound, the battery 134 of the security module 100 is replaceably arranged on a printed circuit board outside the casting compound. The printed circuit board carries the battery contact posts 103 and 104 for the connection of the poles of the battery 134. The security module 100 is plugged to a corresponding interface 8 of the motherboard 9 with the contact groups 101, 102. The first contact group 101 has a communicative connection to the system bus of a control unit, and the second contact group 102 serves the purpose of supplying the security module 100 with the system voltage. Address and data lines 117, 118 as well as control lines 115 proceed via the pins P3, P5–P19 of the contact group 101. The first contact group 101 and/or the second contact group 102 is/are fashioned for static and dynamic monitoring of the plugged state of the security module 100. The supply of the security module 100 with the system voltage of the motherboard 9 is realized via the pins P23 and P25 of the contact group 102, and a dynamic and static unplugged state detection by the security module 100 is realized via the pins P1, P2 or, respectively, P4.

In a known way, the security module 100 has a microprocessor 120 that contains an integrated read-only memory (internal ROM; not shown) with the specific application program that the postal authority or the respective mail carrier has approved for the postage meter machine. Alternatively, a standard read-only memory ROM or FLASH memory can be connected to the module-internal data bus 126.

In a known way, the security module 100 has a reset circuit unit 130, an application circuit (ASIC) 150 and a logic unit 160 that serves as a control signal generator for the ASIC. The reset circuit unit 130 or the application circuit 150 and the logic unit 160 as well as further memories which may be present (not shown) are supplied with system voltage $U_{s+}$ via the lines 191 and 129, this being supplied from the motherboard when the franking device is switched on. European Application 789 33 discloses the basic components of a postal security module that realize the functions of accounting and securing the postal fee data. Via a diode 181 and the line 136, the system voltage $U_{s+}$ is also present at the input of the voltage monitoring unit 12. A second operating voltage $U_{b+}$ is supplied at the output of the voltage monitoring unit 12, this being available via the line 138. When the franking device is switched off, only the battery voltage $U_{b+}$ that is available, rather than the system voltage $U_{s+}$. The battery contact post 104 lying at the negative pole is connected to ground. Battery voltage is supplied from the battery contact post 103 at the positive pole, to the input of the voltage monitoring unit via a line 193, via a second diode 182 and via the line 136. Alternatively to the two diodes 181, 182, a commercially available circuit can be utilized as a voltage switchover 180.

The output of the voltage monitoring unit 12 is connected via a line 138 to an input for this second operating voltage $U_{b+}$ of the processor 120, this leading at least to a RAM memory area and guaranteeing a non-volatile storage thereat as long as the second operating voltage $U_{b+}$ is present with the required amplitude. The processor 120 preferably contains an internal RAM 124 and a real time clock (RTC) 122 as the aforementioned RAM area.

The voltage monitoring unit 12 in the security module 100 executes resettable self-holding that is interrogated by the processor 120 via a line 164 and can be reset via a line 135. For resetting the self-holding, the voltage monitoring unit 12 includes a circuit, wherein the resetting is triggered only when the battery voltage has risen above the predetermined threshold. The resettable self-holding is explained below with reference to FIG. 5.

The lines 135 and 164 are respectively connected to terminals (pin 1 and pin 2) of the processor 120. The line 164 delivers a status signal to the processor 120, and the line 135 delivers a control signal to the voltage monitoring unit 12.

The line 136 at the input of the voltage monitoring unit 12 also supplies the detection unit 13 with operating or battery voltage. The processor 120 interrogates the status of the detection unit 13 via the line 139 or the detection unit 13 is triggered or reset by the processor 120 via the line 137. After being set, a static check for connection is carried out. To that end, ground potential that is present at the terminal P4 of the interface 8 of the postal security module PSM 100 is interrogated via a line 192 and can only be interrogated when the security module 100 is properly plugged in. With the security module 100 plugged in, the terminal P23 of the interface 8 is at ground potential of the negative pole 104 of the battery 134 of the postal security module PSM 100 and thus interrogation at the terminal P4 of the interface 8 can take place by the connection unit 13 via the line 192.

A line loop that is looped back via the pins P1 and P2 of the contact group 102 of the interface 8 to the processor 120 is at the pins 6 and 7 of the processor 120. For dynamic checking of the connected state of the postal security module PSM 100 to the motherboard 9, the processor 120 applies changing signal levels to the pins 6, 7 at absolutely irregular time intervals and these are looped back via the loop.

Figure 2:
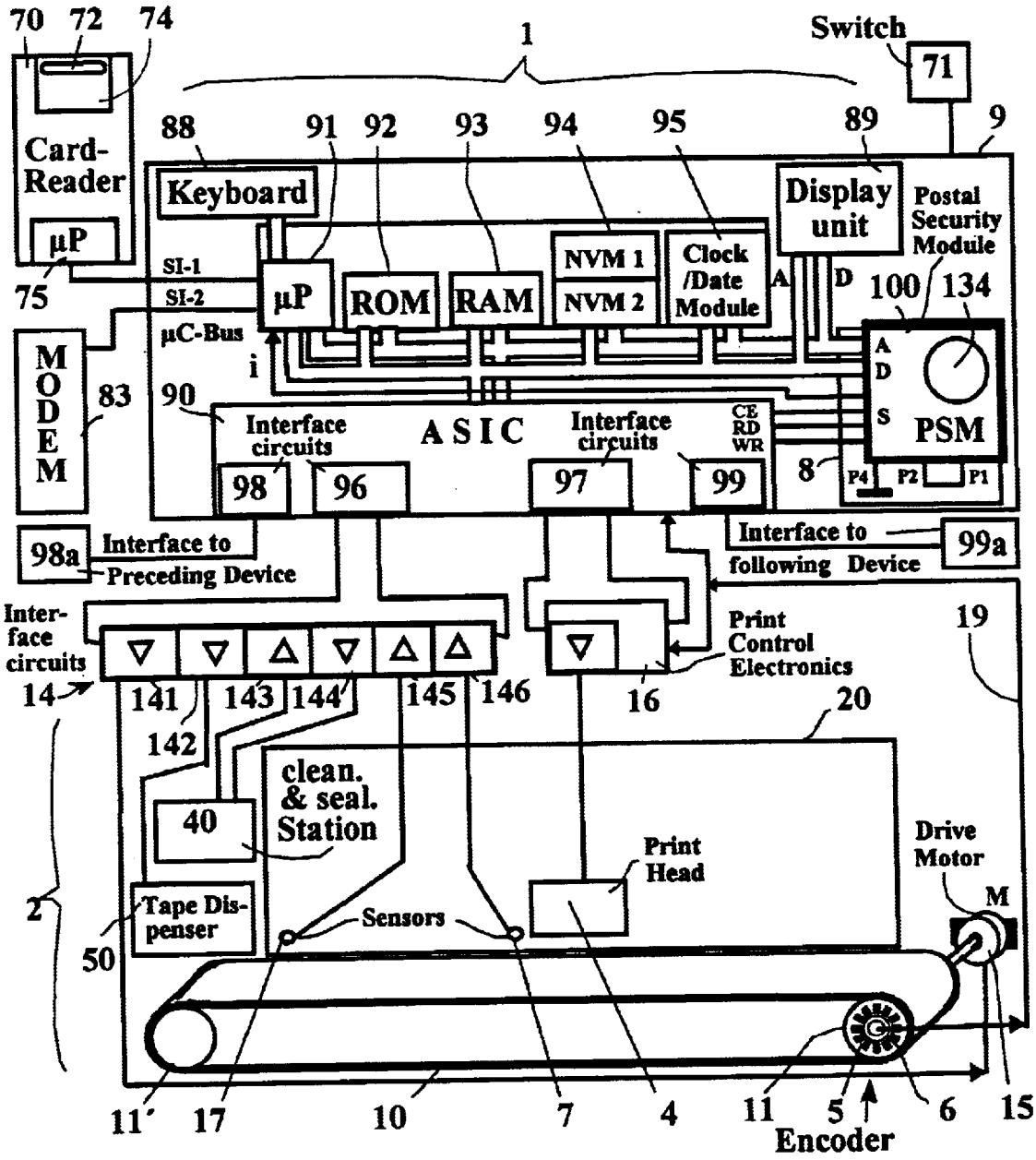
FIG. 2 is a block circuit diagram of an inventive postage meter machine.

FIG. 2 shows a block circuit diagram of a postage meter machine that is equipped with a chip card write/read unit 70 for reloading change data by chip card and with a printer 2 that is controlled by a control unit 1. The control unit 1 includes a motherboard 9 equipped with a microprocessor 91 with appertaining memories 92, 93, 94, 95.

The program memory 92 contains an operating program for printing and for security-relevant components.

The main memory RAM 93 serves for volatile intermediate storage of intermediate results. The non-volatile memory NVM 94 serves for non-volatile intermediate storage of data, for example statistical data that are organized according to cost centers. The calendar/clock module 95 likewise contains addressable but non-volatile memory areas for non-volatile intermediate storage of intermediate results or of known program parts as well (for example, for the DES algorithm). The control unit 1 is connected to the chip card write/read unit 70, and the microprocessor 91 of the control means 1 is programmed, for example, for loading the payload data N from the memory area of a chip card 49 into corresponding memory areas of the postage meter machine. A first chip card 49 plugged into a plug-in slot 72 of the chip card write/read unit 70 allows reloading of a data set into the postage meter machine for at least one application. The chip card 49, for example, contains the postage fees for all standard mail carrier services corresponding to the fee schedule of the postal authority, and contains a mail carrier identifier in order to generate a stamp format with the postage meter machine and frank the pieces of mail in conformity with the fee schedule of the postal authority.

The control unit 1 forms the actual meter with the components 91 through 95 of the aforementioned motherboard 9, and also has keyboard 88, a display unit 89 as well as an application-specific circuit ASIC 90 and the interface 8 for the postal security module PSM 100. The security module PSM 100 is connected via a control bus to the aforementioned ASIC 90 and to the microprocessor 91, and is also connected via the parallel $\mu$C bus to the components 91 through 95 of the motherboard 9 and is also connected to the display unit 89. The control bus carries lines for the signals CE, RD and WR between the security module PSM 100 and the aforementioned ASIC 90. The microprocessor 91 preferably has a pin for an interrupt signal i emitted by the security module PSM 100, further terminals for the keyboard 88, a serial interface SI-1 for the connection of the chip card write/read unit 70 and a serial interface SI-2 for the optional connection of a modem. With the modem, for example, the credit stored in the non-volatile memory of the postal security means PSM 100 can be incremented.

The postal security module PSM 100 is surrounded by a protective housing. Before every franking imprint, a hardware-implemented accounting is conducted in the postal security module PSM 100. The accounting ensues independently of cost centers. The postal security module PSM 100 can be internally implemented, disclosed in detail in European Application 789 333.

The ASIC 90 has a serial interface circuit 98 to a preceding device in the stream of mail, a serial interface circuit 96 to the sensors and actuators of the printer 2, a serial interface circuit 97 to the print control electronics 16 for the print head 4, and a serial interface circuit 99 to a device following the printer 21 in the mail stream. German OS 197 11 997 discloses a modified embodiment for the peripheral interface that is suitable for a number of peripheral devices (stations).

The interface circuit 96 coupled to the interface circuit 14 located in the machine base produces at least one connection to the sensors 7 and 17 and a motor encoder (described below) and to the actuators, for example to the drive motor 15 for the drum 11 and to a cleaning and sealing station RDS 40 for the ink jet print head 4, as well as to the label generator 50 in the machine base. The fundamental arrangement and the interaction between the ink jet print head 4 and the station 40 are described in German PS 197 26 642.

The sensor 17 arranged in the guide plate 20 and serves the purpose of preparing for initiating printing given letter transport. The sensor 7 serves the purpose of recognizing the start of the letter for triggering printing during letter transport. The conveyor is composed of a conveyor belt 10 and two drums 11,11'. The drum 11 is a drive drum equipped with a motor 15; the drum 11' is the entrained tensioning drum. The drive drum 11 is preferably a toothed drum; and the conveyor belt 10 is a toothed belt, thereby assuring positive power transmission. An encoder is coupled to one of the drums 11, 11', in this embodiment the drive drum 11. The drive drum 11 together with an incremental generator 5 is preferably rigidly seated on a shaft. The incremental generator 5 is, for example, a slotted disk that interacts with a light barrier 6 to form the encoder and emits an encoder signal to the motherboard 9 via the line 19.

The individual print elements of the print head 4 are connected to print head electronics within the housing and the print head 4 can be driven for purely electronic printing. The print control ensues on the basis of the path control, with the selected stamp offset being taken into consideration, this being entered via the keyboard 88 or by chip card on demand and being stored in non-volatile fashion in the memory NVM 94. A predetermined imprint is derived from the stamp offset (without printing), the franking print format and, if needed further print formats for advertising slogan, shipping information (selective imprints) and additional messages that can be edited. The non-volatile memory NVM 94 contains a number of memory areas. These include areas that stored the postage fee tables that have been loaded in non-volatile fashion.

The chip card write/read unit 70 is composed of an appertaining mechanical carrier for the microprocessor card and a contacting unit 74. The contacting unit 74 allows dependable mechanical holding of the chip card in the read position and unambiguous signaling of when the read position of the chip card has been reached in the contacting unit 74. The microprocessor card with the microprocessor 75 has a programmed readability for all types of memory cards or chip cards. The interface to the postage meter machine is a serial interface according to the RS232 standard. The data transmission rate amounts to a minimum of 1.2 Kbaud. The power supply is energized with a switch 71 connected to the motherboard 9. After the power supply has been turned on, a self-test function with a readiness message ensues.

Figure 3:
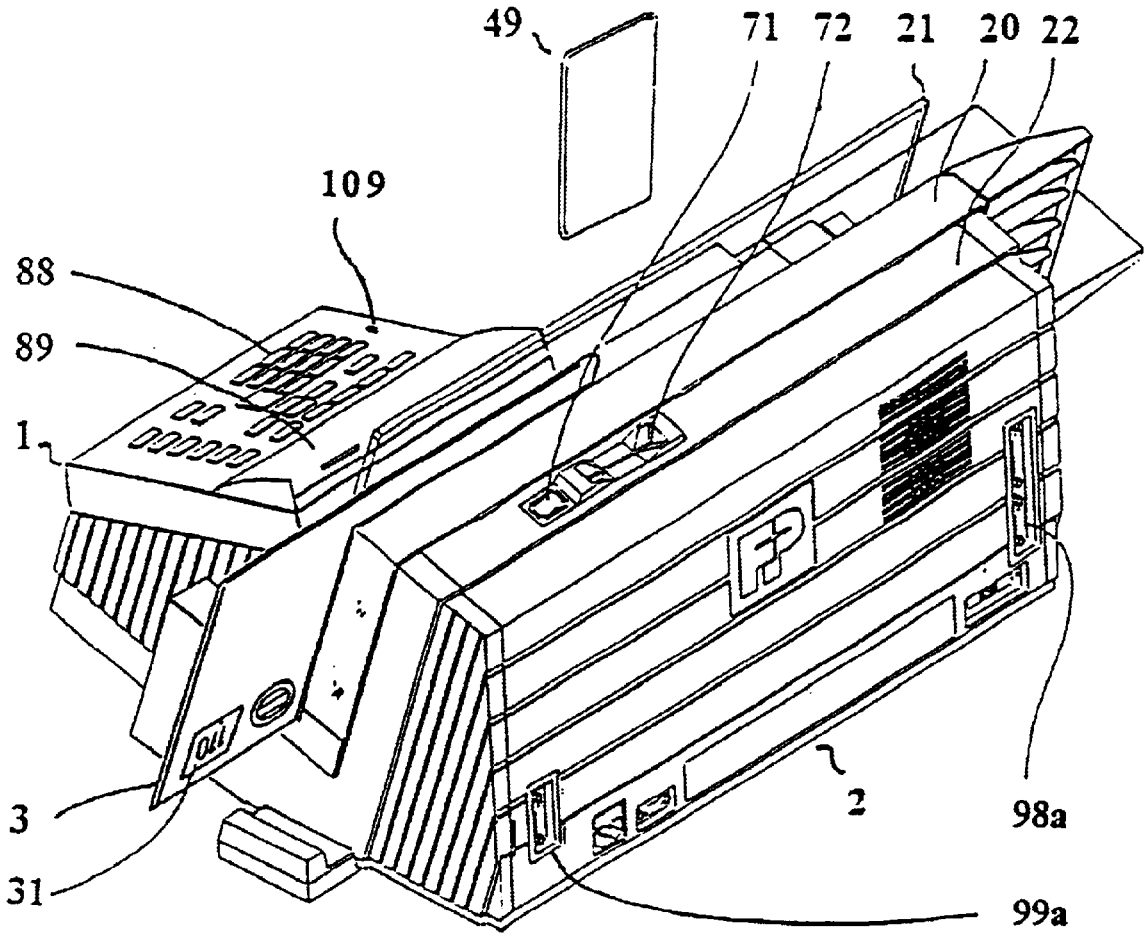
FIG. 3 is a perspective view of the postage meter machine of FIG. 2 from behind.

FIG. 3 shows a perspective view of the postage meter machine from behind. The postage meter machine is composed of a meter 1 and a base 2. The latter is equipped with a chip card write/read unit 70 that is arranged behind the guide plate 20 and is accessible from the upper edge 22 of the housing. After the postage meter machine has been turned on with the switch 71, a chip card 49 is plugged into the plug-in slot 72 from top to bottom. A letter 3 is supplied standing on edge with a surface to be printed lying against the guide plate 20, and is then printed with a franking stamp 31 in conformity with the input data. The letter delivery opening is laterally limited by a transparent plate 21 and by the guide plate 20. The status display of the security module 100 plugged onto the motherboard 9 of the meter 1 is visible from the outside through an opening 109.

Figure 4:
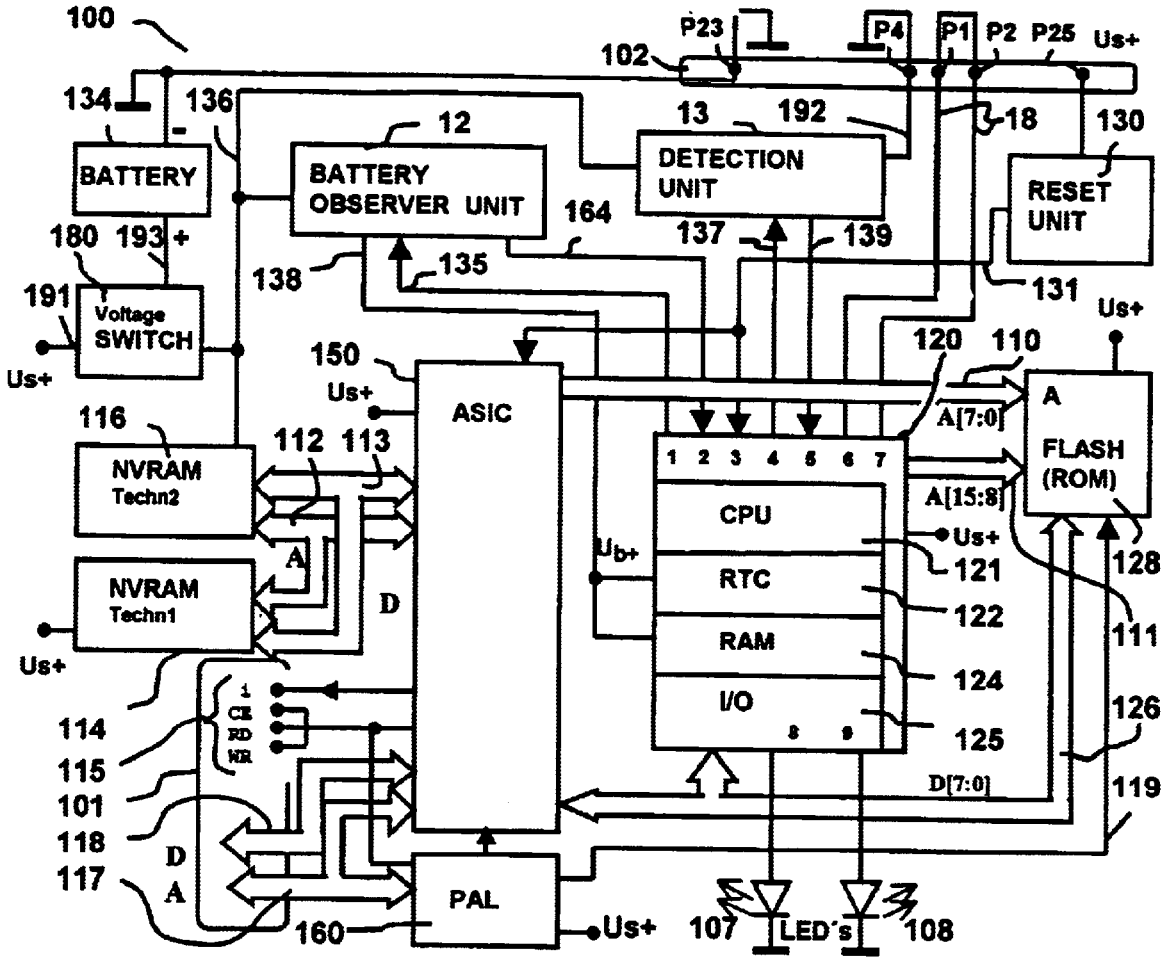
FIG. 4 is a block circuit diagram of the inventive security module in a second embodiment.

FIG. 4 shows a block circuit diagram of the postal security module PSM 100 in a preferred version. The negative pole of the battery 134 is at ground and connected to a pin P23 of the contact group 102. The positive pole of the battery 134 is connected via a line 193 to one input of the voltage switchover 180, and the line 191 carrying the system voltage is connected to the other input of the voltage switchover 180. The type SL-389/P is suitable as the battery 134 for a service life of up to 3.5 years, or the type SL-386/P is suitable for a service life of up to six years given maximum power consumption by the PSM 100. A commercially obtainable circuit of the type ADM 8693ARN can be utilized as the voltage switchover 180. The output of the voltage switchover 180 is supplied to the battery monitoring unit 12 and the detection unit 13 via the line 136. The battery monitoring unit 12 and the detection unit 13 are in communication with the pins 1, 2, 4 and 5 of the processor 120 via the lines 135, 164 and 137, 139. The output of the voltage switchover 180 also is connected via the line 136 to the supply input of a first memory SRAM that serves as a non-volatile memory NVRAM in a first technology as a result of the existing battery 134.

The security module is in communication with the postage meter machine via the system bus 115, 117, 118. The processor 120 can enter into a communication connection with a remote data center via the system bus and a modem 83. The accounting is accomplished by the ASIC 150. The postal accounting data are stored in non-volatile memories of different technologies.

The system voltage is at the supply input of a second memory 114. This is a non-volatile memory (NVRAM) in a second technology (SHADOW RAM). This second technology preferably includes a RAM and an EEPROM, the latter automatically accepting the data contents given an outage of the system voltage. The NVRAM 114 in the second technology is connected to the corresponding address and data inputs of the ASIC 150 via an internal address and data bus 112, 113.

The ASIC 150 contains at least one hardware accounting unit for calculating the postal data to be stored. Access logic to the ASIC 150 is accommodated in the programmable array logic unit 60. The ASIC 150 is controlled by the logic unit 160. An address and control bus 117, 115 from the motherboard 9 is connected to corresponding pins of the logic unit 160, and the logic unit 160 generates at least one control signal for the ASIC 150 and one control signal 119 for the program memory 128. The processor 120 processes a program that is stored in the memory 128. The processor 120, memory 28, ASIC 150 an logic unit 160 are connected to one another via a module-internal system bus that contains lines 110, 111, 126, 119 for data, address and control signals.

The reset unit 130 is connected via the line 131 to the pin 3 of the processor 120 and is connected to a pin of the ASIC 150. The processor 120 and the ASIC 150 are reset in the reset unit 130 by a reset signal when the supply voltage drops.

Lines that form a conductor loop 18 only when the module 100 is plugged to the motherboard 9 connected to the pins 6 and 7 of the processor 120.

The real time clock 122 and the memory 124 are supplied by an operating voltage via the line 138. This voltage is generated via the voltage monitoring unit (battery observer) 12. The latter also supplies a status signal 164 and reacts to a control signal 135. The switchover 180 forwards the larger of its input voltages on the line 136 for the voltage monitoring unit 12 and memory 116.

Internally, the processor 120 includes a processing unit 121, the real time clock 122, the memory 124 and an input/output unit 125. I/O ports of the input/output unit 125 are connected at the pins 8 and 9. Module-internal signal means, for example colored light-emitting diodes LEDs 107, 108 that signal the status of the security module 100, are connected thereto. The security module can assume different indication functions. Thus, for example, they must detect whether the module contains valid cryptographic keys. Further, it is also important to distinguish whether the module is functioning or is defective. The exact type and number of module conditions is dependent on the realized functions in the module and on the implementation.

The processor 120 of the security module 100 is connected via a module-internal data bus 126 to the memory 128 and to the ASIC 150. The memory 128 serves as a program memory and is supplied with system voltage $U_{s+}$, for example, a 128 Kbyte FLASH memory of the type AM29F010-45EC. The ASIC 150 of the postal security module 100—via a module-internal address bus 110—delivers the addresses 0 through 7 to the corresponding address inputs of the memory 128. The processor 120 of the security module 100—via an internal address bus 111—delivers the addresses 8 through 15 to the corresponding address inputs of the FLASH 128. The ASIC 150 of the security module 100 is in communication with the data bus 118, with the address bus 117 and the control bus 115 of the motherboard 9 via the contact group 101 of the interface 8.

Due to the ability to automatically feed the described circuit with the higher of two voltages dependent on the amplitude of the voltages $U_{s+}$ and $U_{b+}$, the battery 134 can be replaced during normal operation without data loss.

In the quiescent times outside normal operation, the battery of the postage meter machine supplies the real time clock 122 with date and/or time of day registers and/or the static memory (SRAM) 124 that maintains security-relevant data in the aforementioned way. If the voltage of the battery drops below a specific limit during battery operation, then the circuit described in the exemplary embodiment connects the feed point for the clock 122 and the static memory 24 to ground, i.e. the voltage at the clock 122 and at the static memory 124 then lies at 0 volts. This causes the static memory 124 that, for example, contains important cryptographic keys, to be very rapidly erased. At the same time, the registers of the clock 122 are also deleted and the current time of day and the current date are lost. This action prevents a possible tamperer from stopping the clock 122 of the postage meter machine by manipulation of the battery voltage without losing security-relevant data. The tamperer thus is prevented from evading security measures such as, for example, long time watchdogs.

Simultaneously with the indication of the under-voltage of the battery, the described circuit changes into a self-holding condition in which it remains even given a subsequent increase in the voltage. The next time the module is switched on, the processor can interrogate the condition of the circuit (status signal) and thus (possibly by the interpretation of the contents of the erased memory) determine that the battery voltage fell below a specific value in the interim. The processor can reset the monitoring circuit.

Figure 5:
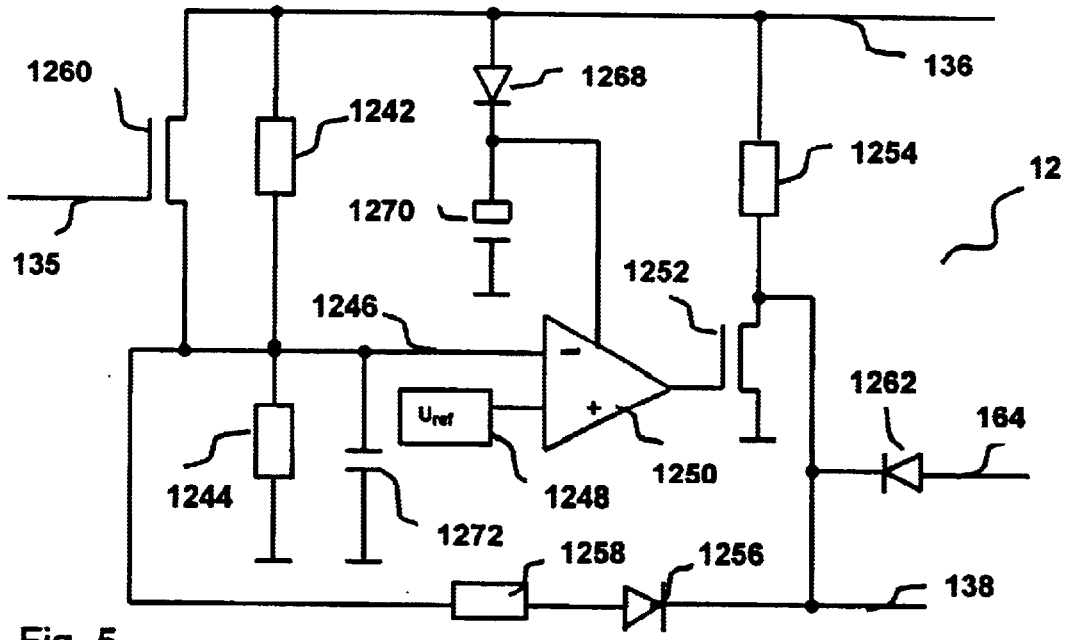
FIG. 5 is a circuit diagram of the voltage monitoring unit in the inventive security module.

The circuit diagram of the voltage monitoring unit (battery observer) 12 is explained on the basis of FIG. 5. The circuit is supplied by the battery voltage on the line 136. In the normal condition, a transistor 1252 is inhibited and the battery voltage-via the resistor 1254—is made available on the line 138 as the operating voltage for the real time clock 122 or the memory 124. The line 138 is the feedline for the clock 122 and the memory 124.

The voltage monitoring unit 12 contains a voltage divider 1242, 1244 between the line 136 and ground that has a tap 1246. The inverting input of a comparator 1250, a circuit 1258 for the self-holding and a circuit 1260 for resetting the self-holding are connected to the tap. The output of the comparator 1250 is connected via a inverter 1252, 1254, to the line 138 and to the circuit 1256 for self-holding. The latter includes a diode that feeds a reference level onto the tap. The voltage divider is composed of two resistors 1242 and 1244 and a capacitor 1272 that is connected between the tap and ground. The branch 1246 at the junction point of the two resistors 1242 and 1244 is connected to the inverting input of the comparator 1250. The non-inverting input of the comparator 1250 is connected to a reference voltage source 1248. The output of the comparator 1250 is conducted to the control input of a transistor 1252 that is connected to ground and is connected to a resistor 1254 at the line 136, i.e. as an inverter. The output of the inverter 1252, 1254 is connected to the line 138 and to the n-side of the diode 1256, whose p-side is connected via a resistor 1258 to the branch 1246. A second transistor 1260, having a control input connected to the line 135, is connected in parallel with the resistor 1242 between the line 136 and the branch 1246.

The battery voltage on the line 136 is reduced by the voltage divider, which is composed of two resistors 1242 and 1244 and the capacitor 1272, and is compared by the comparator 1250 to the reference voltage of the reference voltage source 1248. When the voltage on the branch 1246 is lower than the reference voltage, control input of the transistor 1252 is high and the transistor 1252 is driven. As a result, the line 138 is connected to ground and the clock 122 and the memory 124 are no longer supplied with the battery voltage. This erases the registers of the clock 122 and the data in the memory 124 are erased and the clock 122 stands still.

Since the line 138 is now connected to ground, the voltage at the tap 1246 is pulled to a value close to 0 volts at the same time via diode 1256 and the resistor 1258. As a result, the monitoring circuit 12 switches into a self-holding condition wherein it remains even given an increase in the voltage on the line 136 and the line 138 remains at ground potential. As a result of this condition of the circuit 12, a L-signal is applied. onto the line 164 via a decoupling diode 1262, this signal being interrogated by the processor 120. The decoupling diode 1262 serves the purpose of lowering the power consumption in battery mode. The processor 120 can reset the monitoring circuit 12. To that end, a high reset signal is forwarded on the line 135 to the transistor 1260, the latter being driven. The voltage at the branch 1246 is thus boosted above the reference voltage, the comparator 1250 switches state, and the transistor 1252 is inhibited. The type ICL7665SAIBA is suitable as comparator 1250. A diode 1268 decouples the supply voltage for the comparator 1.250 from the battery voltage. A capacitor 1270 ensures that the comparator 1250 is supplied with the supply voltage over a relatively long time span (>2 s), so the functioning thereof is assured even though the battery voltage on the line 136 was disconnected. The circuit 12 is dimensioned such that any lowering of the battery voltage and the line 136 below the specified threshold of 2.6 V leads to the response of the circuit 12.

Figure 6:
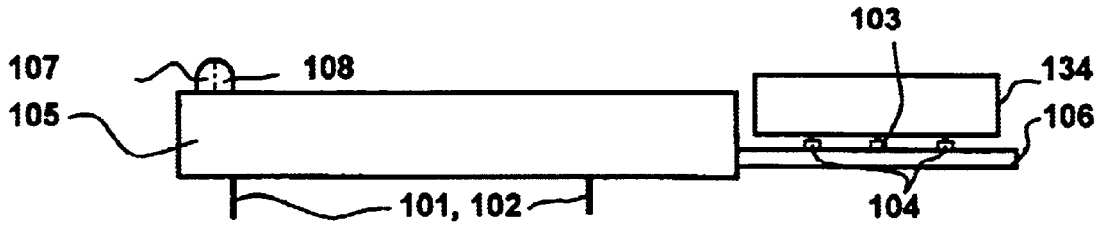
FIG. 6 is a side view of the inventive security module.
Figure 7:
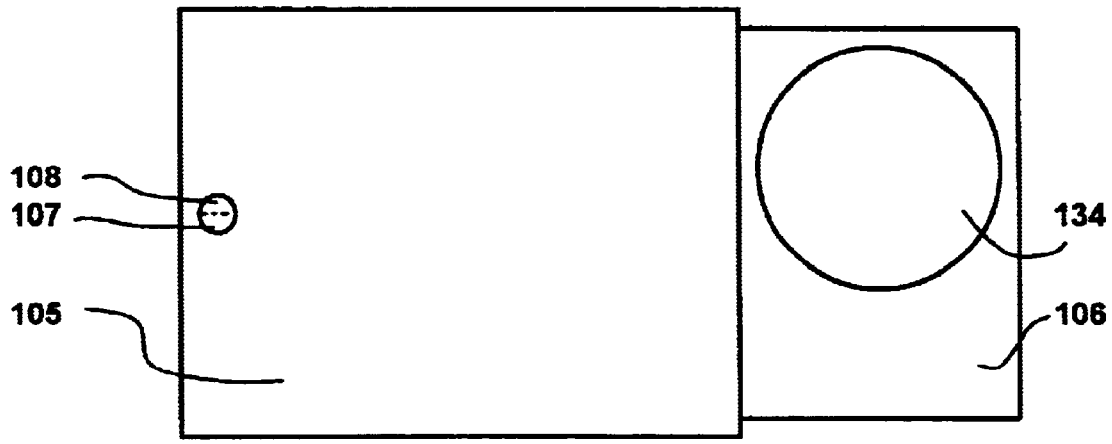
FIG. 7 is a plan view onto the inventive security module.
Figure 8A:
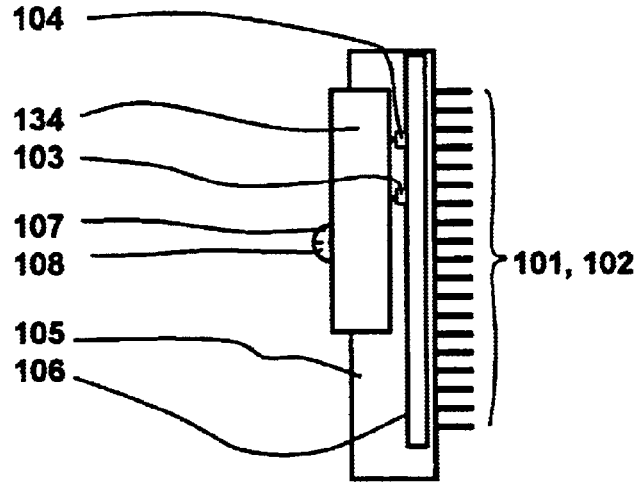
FIG. 8*a* is a view of the inventive security module from the right.
Figure 8B:
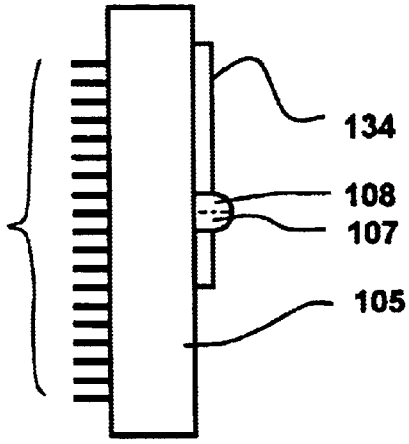
FIG. 8*b* is a view of the inventive security module from the left.

FIG. 6 shows a side view of the mechanical structure of the security module. The security module is fashioned as a multi-chip module, i.e. a number of function units are interconnected on a printed circuit board 106. The security module 100 is potted with a hard casting compound 105, and the battery 134 of the security module 100 is replaceably arranged on the printed circuit board 106 outside the casting compound 105. For example, it is potted with the casting material 105 so that signal elements 107, 108 project from the casting material 106 in a first location, and such that the printed circuit board 106 with the plugged battery 134 projects laterally at a second location. The printed circuit board 106 also has battery contact posts 103 and 104 for the connection of the poles of the battery 134, preferably on the equipping side above the printed circuit board 106. For plugging the postal security module 100 onto the motherboard 9 of the meter 1, the contact groups 101 and 102 are arranged under the printed circuit board 106 (interconnect side) of the security module 100. Via, the first contact group 101, the application circuit ASIC 150 is in communication—in a way that is not shown—with the system bus of the control unit 1 , and the second contact group 102 serves the purpose of supplying the security module 100 with the system voltage. When the security module 100 is plugged onto the motherboard 9, it is preferably arranged such within the meter housing so that the signal elements 107, 108 are close to an opening 109 or projects there into. The meter housing is thus designed such that the user can see the status display of the security module from the outside. The two signal elements (light-emitting diodes) 107 and 108 are controlled via two output signals of the I/O ports at the pins 8, 9 of the processor 120. Both light-emitting diodes are accommodated in a common component housing (bi-color light-emitting diode), for which reason the dimensions or the diameter of the opening can be relatively small, on the order of magnitude of the signal element. Fundamentally, three different colors can be displayed (red, green, orange), but only two are used (red and green). For distinguishing between statuses, the LEDs are also used in flashing fashion, so that different status groups can be distinguished, these being characterized, for example by the following LED conditions: LED off, LED flashing red, LED red, LED flashing green, LED green. FIG. 7 shows a plan view onto the postal security module. FIGS. 8*a* and 8*b* show views of the security module from the right and, respectively left. The position of the contact groups 101 and 102 on the printed circuit board 106 can be seen from FIGS. 8*a* and 8*b* in conjunction with FIG. 6.

The postal device is, in particular, a postage meter machine; however, the security module can have a different structure that, for example, allows it to be plugged onto the motherboard of a personal computer that, as a PC franker, drives a commercially obtainable printer.

Although modifications and changes may be suggested by those skilled in the art, it is the intention of the inventors to embody within the patent warranted hereon all changes and modifications as reasonably and properly come within the scope of their contribution to the art.

We claim as our invention:

1. A security module arrangement for use with a source of operating voltage, comprising:

a secured housing;

a processor in said secured housing;

a memory in said secured housing accessible by said processor and having memory contents, said memory requiring a minimum voltage at said memory in order to preserve said memory contents;

a switching circuit in said secured housing having a connection for receiving operating voltage if operating voltage is available;

externally accessible battery terminals at said secured housing, connected across said switching circuit;

a battery replaceably and releasably connected to said battery terminals, said switching circuit supplying voltage above said minimum voltage to said memory from said battery if said operating voltage is not available;

a voltage monitoring circuit connected in said secured housing between said switching circuit and said memory having resettable voltage maintenance, triggered if said voltage from said battery is below a predetermined threshold, to cause said minimum voltage at said memory to be maintained to allow replacement of said battery;

a reset unit which determines when said voltage from said battery rises above said predetermined threshold, after said voltage from said battery has fallen below said predetermined threshold; and said voltage monitoring unit comprising a switch which is caused to change switching state by said resetting unit for resetting said voltage monitoring circuit, a line connection to said switching circuit, and a ground connection, a voltage divider connected between said line connection and said ground connection, said voltage divider having a divider tap, a comparator with an inverting input connected to said tap, and a non-inverting input and an output, a first voltage maintenance circuit also connected to said tap, and a second voltage maintenance circuit connected via an inverter to said output of said comparator, and connected to said memory.

2. A security module arrangement as claimed in claim 1 wherein said second voltage maintenance circuit comprises a diode.

3. A security module arrangement as claimed in claim 1 further comprising a reference voltage source in said voltage monitoring circuit connected to said non-inverting input of said comparator.

4. A security module arrangement as claimed in claim 1 wherein said voltage monitoring circuit further comprises a line connecting said output of said comparator to said processor for allowing said processor to interrogate a status of said resettable voltage maintenance.

5. A security module arrangement as claimed in claim 4 wherein said processor is connected between said reset unit and said voltage monitoring circuit, said processor also being connected to said switching circuit and being supplied with said operating voltage from said switching circuit if said operating voltage is available and also being connected between said reset unit and said switch in said voltage monitoring circuit to reset said switch upon receiving a signal from said reset unit.

6. A security module arrangement as claimed in claim 5 further comprising an ASIC in said secured housing and a data bus in said secured housing connecting said processor and said ASIC, and an externally accessible contact group at said secured housing providing external connections to said ASIC.

7. A security module arrangement as claimed in claim 1 wherein said secured housing is comprised of a hard casting compound and wherein said secured housing has an externally accessible printed circuit board, containing said battery terminals and also having a contact group connectable to said source of operating voltage.

* * * * *